US006453778B1

(12) United States Patent
Long

(10) Patent No.: US 6,453,778 B1
(45) Date of Patent: Sep. 24, 2002

(54) TOOL LENGTHENING DEVICE

(76) Inventor: Douglas G. Long, 3293 Morgan Center Rd., Utica, OH (US) 43080

( * ) Notice: Subject to any disclaimer, the term of this patent is extended or adjusted under 35 U.S.C. 154(b) by 0 days.

(21) Appl. No.: 09/844,329

(22) Filed: Apr. 27, 2001

(51) Int. Cl.[7] ..... B25B 17/00
(52) U.S. Cl. ..... 81/57.13; 81/57.29
(58) Field of Search ..... 81/57, 57.11, 57.13, 81/57.29

(56) References Cited

U.S. PATENT DOCUMENTS

| | | | | |
|---|---|---|---|---|
| 2,814,224 A | | 11/1957 | Allard | |
| 3,913,428 A | | 10/1975 | Brunson | |
| 4,436,003 A | | 3/1984 | Cox | |
| 4,656,894 A | | 4/1987 | Goetz | |
| 4,735,118 A | * | 4/1988 | Broemel, Jr. | 81/57.13 |
| 4,765,209 A | | 8/1988 | Klebold et al. | |
| 4,867,016 A | | 9/1989 | Di Edwardo | |
| D322,203 S | | 12/1991 | Kanyuck, Sr. | |
| 5,887,494 A | * | 3/1999 | Papandreou | 81/57.13 |

* cited by examiner

*Primary Examiner*—Eileen P. Morgan
*Assistant Examiner*—Joni B. Danganan

(57) ABSTRACT

A tool lengthening device for lengthening a tool and transferring torque for bit type tools. The tool lengthening device includes a plate which is elongated and has a first end, a second end. A bracket removably couples the plate to a drill. A pair of sprockets are rotatably coupled to the plate and spaced from each other. A roller chain engages the teeth of the sprockets. A first gear portion is coupled to the first sprocket. A second gear portion is coupled to the second sprocket and is releasably engaged to said drill. A bit receiving member removably engages a bit and is attached to and extending downwardly from the second sprocket.

8 Claims, 3 Drawing Sheets

TOOL LENGTHENING DEVICE

BACKGROUND OF THE INVENTION

1. Field of the Invention

The present invention relates to tools and more particularly pertains to a new tool lengthening device for lengthening a tool and transferring torque for bit type tools.

2. Description of the Prior Art

The use of tools is known in the prior art. More specifically, tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,913,428; U.S. Pat. No. 4,867,016; U.S. Pat. No. 4,656,894; U.S. Patent. No. 2,814,224; U.S. Pat. No. 4,765,209; U.S. Pat. No. 4,436,003; and U.S. Des. Pat. No. 322,203.

While these devices fulfill their respective, particular objectives and requirements, the aforementioned patents do not disclose a new tool lengthening device. The inventive device includes a plate which is elongated and has a first end, a second end, a top surface and a bottom surface. The plate has a first aperture extending through the top and bottom surfaces and positioned adjacent to the first end and a second aperture extending through the top and bottom surfaced and positioned adjacent to the second end. A bracket removably couples the plate to the drill. A first sprocket rotatably positioned in the first aperture such that teeth of the first sprocket are positioned adjacent to the bottom surface of the plate. A second sprocket is rotatably positioned in the second aperture such that teeth of the second sprocket are positioned adjacent to the bottom surface of the plate. A roller chain extends around the first and second sprockets and engages the teeth on the first and second sprockets. A first gear member is attached to the first sprocket and extends upwardly from the plate. A second gear member comprises a shank having a first end and a second end. The first end of the shank is removably attached to a jaw of a drill. The second end of the shank has a gear thereon and in communication with the gear on the first gear member. A bit receiving member removably engages a bit and is attached to and extending downwardly from the second sprocket.

In these respects, the tool lengthening device according to the present invention substantially departs from the conventional concepts and designs of the prior art, and in so doing provides an apparatus primarily developed for the purpose of lengthening a tool and transferring torque for bit type tools.

SUMMARY OF THE INVENTION

In view of the foregoing disadvantages inherent in the known types of tools now present in the prior art, the present invention provides a new tool lengthening device construction wherein the same can be utilized for lengthening a tool and transferring torque for bit type tools.

The general purpose of the present invention, which will be described subsequently in greater detail, is to provide a new tool lengthening device apparatus and method which has many of the advantages of the tools mentioned heretofore and many novel features that result in a new tool lengthening device which is not anticipated, rendered obvious, suggested, or even implied by any of the prior art tools, either alone or in any combination thereof.

To attain this, the present invention generally comprises a plate which is elongated and has a first end, a second end, a top surface and a bottom surface. The plate has a first aperture extending through the top and bottom surfaces and positioned adjacent to the first end and a second aperture extending through the top and bottom surfaced and positioned adjacent to the second end. A bracket removably couples the plate to the drill. A first sprocket rotatably positioned in the first aperture such that teeth of the first sprocket are positioned adjacent to the bottom surface of the plate. A second sprocket is rotatably positioned in the second aperture such that teeth of the second sprocket are positioned adjacent to the bottom surface of the plate. A roller chain extends around the first and second sprockets and engages the teeth on the first and second sprockets. A first gear member is attached to the first sprocket and extends upwardly from the plate. A second gear member comprises a shank having a first end and a second end. The first end of the shank is removably attached to a jaw of a drill. The second end of the shank has a gear thereon and in communication with the gear on the first gear member. A bit receiving member removably engages a bit and is attached to and extending downwardly from the second sprocket.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tool lengthening device apparatus and method which has many of the advantages of the tools mentioned heretofore and many novel features that result in a new tool lengthening device which is not anticipated, rendered obvious, suggested, or even implied by any of the prior art tools, either alone or in any combination thereof.

It is another object of the present invention to provide a new tool lengthening device which may be easily and efficiently manufactured and marketed.

It is a further object of the present invention to provide a new tool lengthening device which is of a durable and reliable construction.

An even further object of the present invention is to provide a new tool lengthening device which is susceptible of a low cost of manufacture with regard to both materials and labor, and which accordingly is then susceptible of low prices of sale to the consuming public, thereby making such tool lengthening device economically available to the buying public.

Still yet another object of the present invention is to provide a new tool lengthening device which provides in the apparatuses and methods of the prior art some of the advantages thereof, while simultaneously overcoming some of the disadvantages normally associated therewith.

Still another object of the present invention is to provide a new tool lengthening device for lengthening a tool and transferring torque for bit type tools.

Yet another object of the present invention is to provide a new tool lengthening device which includes a plate which is elongated and has a first end, a second end, a top surface and a bottom surface. The plate has a first aperture extending through the top and bottom surfaces and positioned adjacent to the first end and a second aperture extending through the top and bottom surfaced and positioned adjacent to the second end. A bracket removably couples the plate to the drill. A first sprocket is rotatably positioned in the first aperture such that teeth of the first sprocket are positioned adjacent to the bottom surface of the plate. A second sprocket is rotatably positioned in the second aperture such that teeth of the second sprocket are positioned adjacent to the bottom surface of the plate. A roller chain extends around the first and second sprockets and engages the teeth on the first and second sprockets. A first gear member is attached to the first sprocket and extends upwardly from the plate. A second gear member comprises a shank having a first end and a second end. The first end of the shank is removably attached to a jaw of a drill. The second end of the shank has a gear thereon and in communication with the gear on the first gear member. A bit receiving member removably engages a bit and is attached to and extending downwardly from the second sprocket.

Still yet another object of the present invention is to provide a new tool lengthening device that allows torque to be transferred away from an electric drill to a bit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
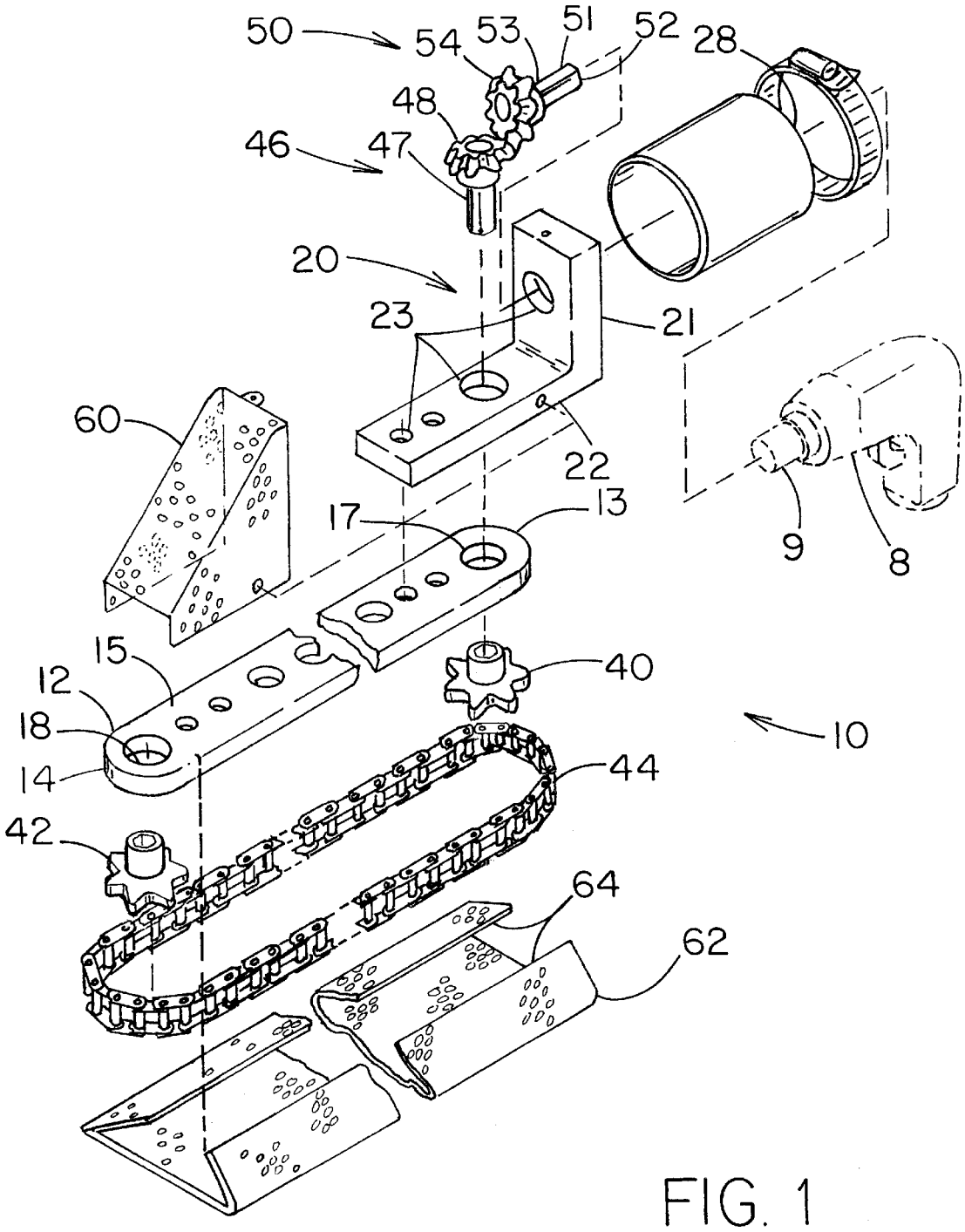
FIG. 1 is a schematic perspective view of a new tool lengthening device according to the present invention.
Figure 2:
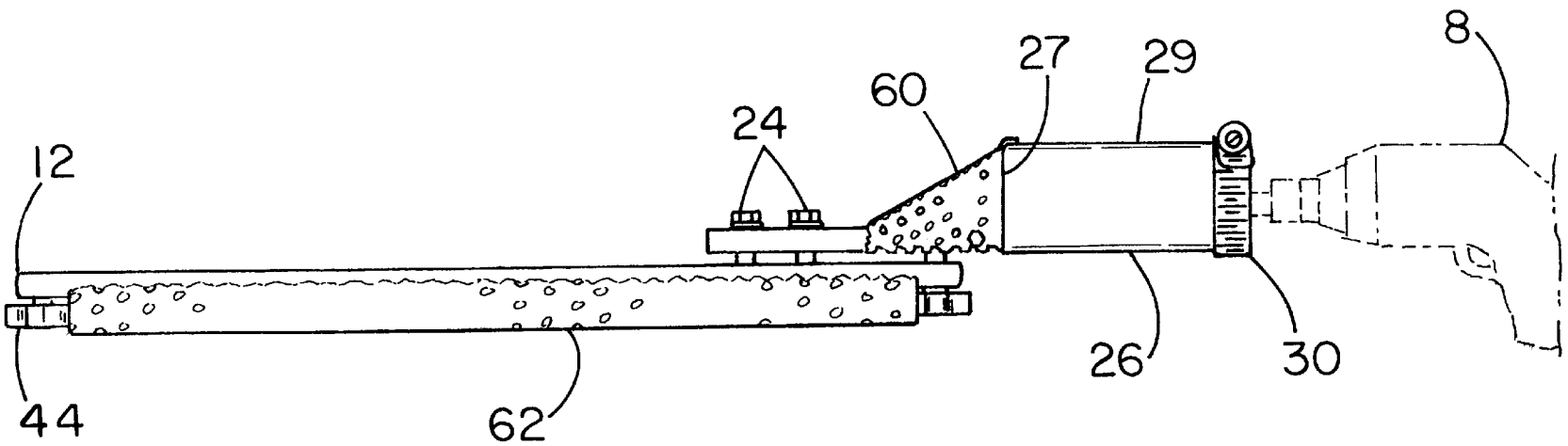
FIG. 2 is a schematic side view of the present invention.
Figure 3:
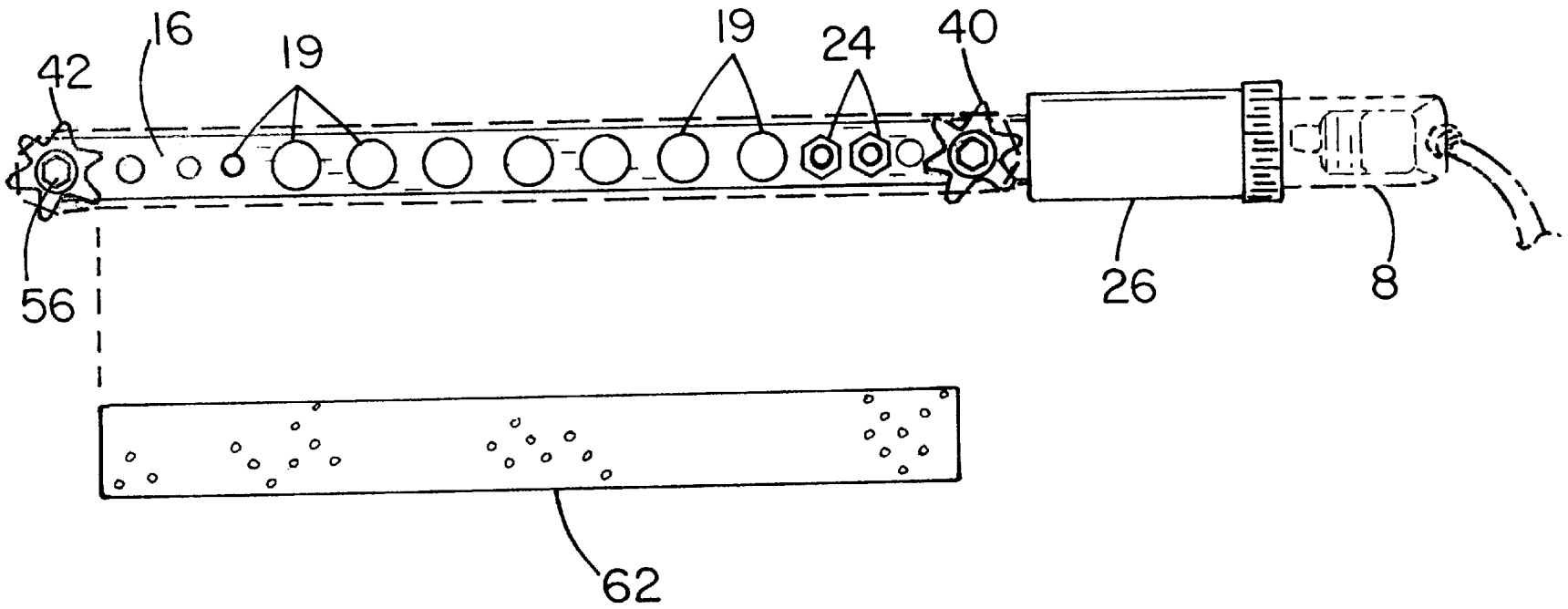
FIG. 3 is a schematic bottom view of the present invention.

With reference now to the drawings, and in particular to FIGS. 1 through 3 thereof, a new tool lengthening device embodying the principles and concepts of the present invention and generally designated by the reference numeral 10 will be described.

As best illustrated in FIGS. 1 through 3, the tool lengthening device 10 generally comprises a plate 12 which is elongated and has a first end 13, a second end 14, a top surface 15 and a bottom surface 16. The plate 12 has a first aperture 17 extending through the top 15 and bottom 16 surfaces and positioned adjacent to the first end 13 and a second aperture 18 extending through the top and bottom surfaces and positioned adjacent to the second end 14. The first 13 and second 14 ends are preferably rounded. A plurality of holes 19 extend through the top 15 and bottom 16 surfaces and are positioned between the first 17 and the second 18 apertures. The holes 19 are for mounting other elements to the plate 12 as will be shown below and for decreasing the weight of the plate.

A bracket 20 removably couples the plate 12 to a drill 8. The bracket 20 includes a first panel 21 and a second panel 22 integrally coupled together at an edge such that the panels 21, 22 lie in planes orientated perpendicular to each other. Each of the panels is substantially rigid. The first panel 21 has one opening 23 extending therethrough. The second panel 22 has a three openings 23 extending therethrough.

Each of a pair of fasteners 24 extends through two of the openings 23 in the Second panel 22 and through two of the holes 19 in plate 12 positioned relatively adjacent to the first aperture 17 such that the second panel 22 is attached to the plate 12.

A tube 26 has a first end 27, a second end 28, and a peripheral wall 29 extending between the first 27 and second 28 ends. The first 27 and second 28 ends are open. The first end 27 is attached to the first panel 21 such that the tube 26 generally covers the opening 23 in the first panel 21 and the tube 26 extends in the opposite direction from first panel with respect to the second panel 22.

A coupling member 30 releasably couples the tube 26 to a body of a drill 8 when the drill 6 is extended into the tube 26. The coupling member 30 comprises a ring clamp positionable around the peripheral wall 29 of the tube 26.

A first sprocket 40 is rotatably positioned in the first aperture 17 such that teeth of the first sprocket 40 are positioned adjacent to the bottom surface 16 of the plate 12.

A second sprocket 42 is rotatably positioned in the second aperture 18 such that teeth of the second sprocket 42 are positioned adjacent to the bottom surface 16 of the plate 12.

A roller chain 44 extends around the first 40 and second 42 sprockets and engages the teeth on the first 40 and second 42 sprockets.

A first gear member 46 comprises a rod 47 attached to the first sprocket 40 and extends upwardly from the top surface of the plate 12 and through one of the holes 23 in the second panel 22. A gear 48 is attached to a free end of the rod 47.

A second gear member 50 comprises a shank 51 having a first end 52 and a second end 53. The first end 52 of the shank 51 is removably attached to a jaw 9 of the drill 8. The shank 51 extends through the opening 23 in the first panel 21 when the drill 8 is positioned in the tube 26. The second end 53 of the shank 51 has a gear 54 thereon and communication with the gear 48 on the first gear member 46. Rotation of the second gear member 50 rotates the first gear member 46 which in turn rotates the first sprocket 40 such that the roller chain 44 is rotated.

A bit receiving member 56 removably engages a bit. The bit receiving member 56 is attached to and. extends downwardly from the second sprocket 42.

A first guard member 60 is positioned over a top side of and attached to the bracket 20 for generally covering the first 46 and second 50 gear members.

A second guard member 62 has a pair of side edges 64 each coupled to one of a pair of opposite edges of the plate 12 such that the second guard member 62 is positioned below and generally covers the bottom surface 16 of the plate such that the second sprocket 42 is not covered.

In use, the shank 51 is coupled to the jaw 9 of the drill 8 so that the gears may rotate a bit in the bit receiving member 56. The second sprocket 42 rotates a bit receiving member 56 which may receive a conventional bit. The device 10 allows a user to reach bolts, nuts and screws which are difficult to reach due to space constraints.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool extension device for removably coupling to the body of an electric drill, the drill having a jaw therein for releasably gripping a shank, said device comprising:

a plate being elongated and having a first end, a second end, a top surface and a bottom surface, said plate having a first aperture extending through said top and bottom surfaces and positioned adjacent to said first end and a second aperture extending through said top and bottom surfaced and positioned adjacent to said second end;

a bracket removably couples said plate to said drill, said bracket including;

a first sprocket being rotatably positioned in said first aperture such that teeth of said first sprocket are positioned adjacent to said bottom surface of said plate;

a second sprocket being rotatably positioned in said second aperture such that teeth of said second sprocket are positioned adjacent to said bottom surface of said plate;

a roller chain extending around said first and second sprockets and engaging said teeth on said first and second sprockets;

a first gear member attached to said first sprocket and extending upwardly from said plate;

a second gear member comprising a shank having a first end and a second end, said first end of said shank being removably attached to said jaw of said drill, said second end of said shank having a gear thereon and in communication with said gear on said first gear member; and a bit receiving member for removably engaging a bit, said bit receiving member being attached to and extending downwardly from said second sprocket.

2. The tool extension device as in claim 1, wherein said plate having a plurality of holes extending through said top and bottom surfaces and being positioned between said first and second apertures.

3. The tool extension device as in claim 2, wherein said bracket includes;

a first panel and a second panel integrally coupled together at an edge such that said panels lie in planes orientated perpendicular to each other, each of said panels being substantially rigid, said first panel having one opening extending therethrough, said second panel having a three openings extending therethrough;

each of a pair of fasteners extending through two of said openings in said second panel and through two of said holes in said plate positioned relatively adjacent to said first aperture such that said second panel is attached to said plate;

said shank extending through said opening in said first panel and said first gear member extending through one of said hole in said second panel; and a tube having a first end, a second end, and a peripheral wall extending between said first and second ends, said first and second ends being open, said first end being attached to said first panel such that said tube generally covers said opening in said first panel and said tube extends in the opposite direction from said first panel with respect to said second panel, wherein said drill is extended into said tube.

4. The tool extension device as in claim 3, wherein said bracket further includes a coupling member for releasably coupling said tube to said body of said drill when said drill is extended into said tube.

5. The tool extension device as in claim 4, wherein said coupling member comprises a ring clamp positionable around said peripheral wall of said tube.

6. The tool extension device as in claim 3, further including:

a first guard member being positioned over a top side of and attached to said bracket for generally covering said first and second gear members.

7. The tool extension device as in claim 6, further including:

a second guard member having a pair of side edges each coupled to one of a pair of opposite edges of said plate such that second guard member is positioned below and generally covers said bottom surface of said plate such that said second sprocket is not covered.

8. A tool extension device for removably coupling to the body of an electric drill, the drill having a jaw therein for releasably gripping a shank, said device comprising:

a plate being elongated and having a first end, a second end, a top surface and a bottom surface, said plate having a first aperture extending through said top and bottom surfaces and positioned adjacent to said first end and a second aperture extending through said top and bottom surfaced and positioned adjacent to said second end, said first and second ends being rounded, a plurality of holes extending through said top and bottom surfaces and being positioned between said first and second apertures;

a bracket removably couples said plate to said drill, said bracket including;

a first panel and a second panel integrally coupled together at an edge such that said panels lie in planes orientated perpendicular to each other, each of said panels being substantially rigid, said first panel having one opening extending therethrough, said second panel having a three openings extending therethrough;

each of a pair of fasteners extending through two of said openings in said second panel and through two of said holes in said plate positioned relatively adjacent to said first aperture such that said second panel is attached to said plate;

a tube having a first end, a second end, and a peripheral wall extending between said first and second ends, said first and second ends being open, said first end being attached to said first panel such that said tube generally covers said opening in said first panel and said tube extends in the opposite direction from said first panel with respect to said second panel;

a coupling member releasably couples said tube to said body of said drill when said drill is extended into said tube, said coupling member comprising a ring clamp positionable around said peripheral wall of said tube;

a first sprocket being rotatably positioned in said first aperture such that teeth of said first sprocket are positioned adjacent to said bottom surface of said plate;

a second sprocket being rotatably positioned in said second aperture such that teeth of said second sprocket are positioned adjacent to said bottom surface of said plate;

a roller chain extending around said first and second sprockets and engaging said teeth on said first and second sprockets;

a first gear member comprising a rod attached to said first sprocket and extending upwardly from said top surface of said plate and through one of said holes in said second panel, a gear being attached to a free end of said rod;

a second gear member comprising a shank having a first end and a second end, said first end of said shank being removably attached to said jaw of said drill, said shank extending through said opening in said first panel when said drill is positioned in said tube, said second end of said shank having a gear thereon and in communication with said gear on said first gear member, wherein rotation of said second gear member rotates said first gear member which in turn rotates said first sprocket such that said roller chain is rotated;

a bit receiving member for removably engaging a bit, said bit receiving member being attached to and extending downwardly from said second sprocket;

a first guard member being positioned over a top side of and attached to said bracket for generally covering said first and second gear members; and a second guard member having a pair of side edges each coupled to one of a pair of opposite edges of said plate such that second guard member is positioned below and generally covers said bottom surface of said plate such that said second sprocket is not covered.

* * * * *